US011988092B2

(12) United States Patent
Moeny

(10) Patent No.: US 11,988,092 B2
(45) Date of Patent: May 21, 2024

(54) SWITCHES FOR DOWNHOLE ELECTROCRUSHING DRILLING

(71) Applicants: Halliburton Energy Services, Inc., Houston, TX (US); Chevron U.S.A. Inc., San Ramon, CA (US); SDG LLC, Minden, NV (US)

(72) Inventor: William M. Moeny, Bernalillo, NM (US)

(73) Assignees: Halliburton Energy Services, Inc., Houston, TX (US); Chevron U.S.A. Inc., San Ramon, CA (US); SDG LLC, Minden, NV (US)

( * ) Notice: Subject to any disclaimer, the term of this patent is extended or adjusted under 35 U.S.C. 154(b) by 0 days.

(21) Appl. No.: 17/065,064

(22) Filed: Oct. 7, 2020

(65) Prior Publication Data

US 2021/0025240 A1 Jan. 28, 2021

Related U.S. Application Data

(62) Division of application No. 15/778,496, filed as application No. PCT/US2016/018925 on Feb. 22, 2016, now abandoned.

(51) Int. Cl.
*E21B 7/15* (2006.01)
*E21B 10/00* (2006.01)

(52) U.S. Cl.
CPC ..... *E21B 7/15* (2013.01); *E21B 10/00* (2013.01)

(58) Field of Classification Search
CPC ..... E21B 7/15; E21B 10/00
See application file for complete search history.

(56) References Cited

U.S. PATENT DOCUMENTS 2,822,148 A * 2/1958 Murray ..... E21B 7/15 175/97
2,961,641 A * 11/1960 Johnstone ..... G01R 29/02 340/12.15
5,896,938 A 4/1999 Moeny et al.
6,134,892 A 10/2000 Turner et al.
8,148,943 B2 4/2012 Forslöw
8,567,522 B2 10/2013 Moeny
(Continued)

FOREIGN PATENT DOCUMENTS

WO 2015/124733 8/2015
WO 2015/171334 11/2015

OTHER PUBLICATIONS

International Search Report and Written Opinion for PCT Patent Application No. PCT/US2016/018925, dated Nov. 7, 2016; 17 pages.

(Continued)

*Primary Examiner* — Nicole Coy
*Assistant Examiner* — Nicholas D Wlodarski
(74) *Attorney, Agent, or Firm* — DeLizio, Peacock, Lewin and Guerra, LLP

(57) ABSTRACT

A downhole drilling system is disclosed. The downhole drilling system may include a bottom-hole assembly having a pulse-generating circuit and a switching circuit within the pulse-generating circuit, the switching circuit comprising a solid-state switch. The downhole drilling system may also include a drill bit having a first electrode and a second electrode electrically coupled to the pulse-generating circuit to receive a pulse from the pulse-generating circuit.

15 Claims, 6 Drawing Sheets

(56) References Cited

U.S. PATENT DOCUMENTS

| | | | | |
|---|---|---|---|---|
| 10,090,830 | B2 | 10/2018 | Vershinin et al. | |
| 2006/0243486 | A1 | 11/2006 | Moeny | |
| 2012/0134890 | A1* | 5/2012 | Kinoshita | C01B 13/115 422/186.07 |
| 2012/0168177 | A1* | 7/2012 | Moeny | E21B 10/00 166/380 |
| 2015/0083491 | A1* | 3/2015 | Moeny | E21B 7/15 307/112 |
| 2015/0187970 | A1 | 7/2015 | Curry et al. | |
| 2017/0067292 | A1 | 3/2017 | Bayol et al. | |
| 2018/0347282 | A1 | 12/2018 | Moeny | |

OTHER PUBLICATIONS

Extended European Search Report for European Patent Application No. 16891793.8, dated Dec. 19, 2018; 9 pages.
Office Action for Canadian Patent Application No. 3010353, dated Apr. 5, 2019; 4 pages.
Office Action for European Patent Application No. 16891793.8, dated Aug. 2, 2019; 5 pages.

* cited by examiner

SWITCHES FOR DOWNHOLE ELECTROCRUSHING DRILLING

RELATED APPLICATIONS

This application is a Divisional Application of U.S. application Ser. No. 15/778,496 filed May 23, 2018, which is a U.S. National Stage Application of International Application No. PCT/US2016/018925 filed Feb. 22, 2016, which designates the United States.

TECHNICAL FIELD

The present disclosure relates generally to downhole electrocrushing drilling and, more particularly, to switches utilized in downhole electrocrushing drilling.

BACKGROUND

Electrocrushing drilling uses pulsed power technology to drill a borehole in a rock formation. Pulsed power technology repeatedly applies a high electric potential across the electrodes of an electrocrushing drill bit, which ultimately causes the surrounding rock to fracture. The fractured rock is carried away from the bit by drilling fluid and the bit advances downhole.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Electrocrushing drilling may be used to form wellbores in subterranean rock formations for recovering hydrocarbons, such as oil and gas, from these formations. Electrocrushing drilling uses pulsed-power technology to repeatedly fracture the rock formation by repeatedly delivering high-energy electrical pulses to the rock formation. In some applications, certain components of a pulsed-power system may be located downhole. For example, a pulse-generating circuit may be located in a bottom-hole assembly (BHA) near the electrocrushing drill bit. The pulse-generating circuit may include one or more switches. For example, the pulse-generating circuit may include one or more solid-state switches. As another example, the pulse-generating circuit may include one or more magnetic switches. Such switches may be capable of withstanding the high voltages and the high currents utilized in the pulsed-power system. Moreover, such switches may be capable of withstanding harsh environment of a downhole pulsed-power system. The switches may operate over a wide temperature range (for example, from 10 to 150 degrees Centigrade or from 10 to 200 degrees Centigrade), and may physically withstand the vibration and mechanical shock resulting from the fracturing of rock during downhole electrocrushing drilling.

There are numerous ways in which solid-state switches and magnetic switches may be implemented in a downhole electrocrushing pulsed-power system. Thus, embodiments of the present disclosure and its advantages are best understood by referring to FIGS. 1 through 8, where like numbers are used to indicate like and corresponding parts.

Figure 1:
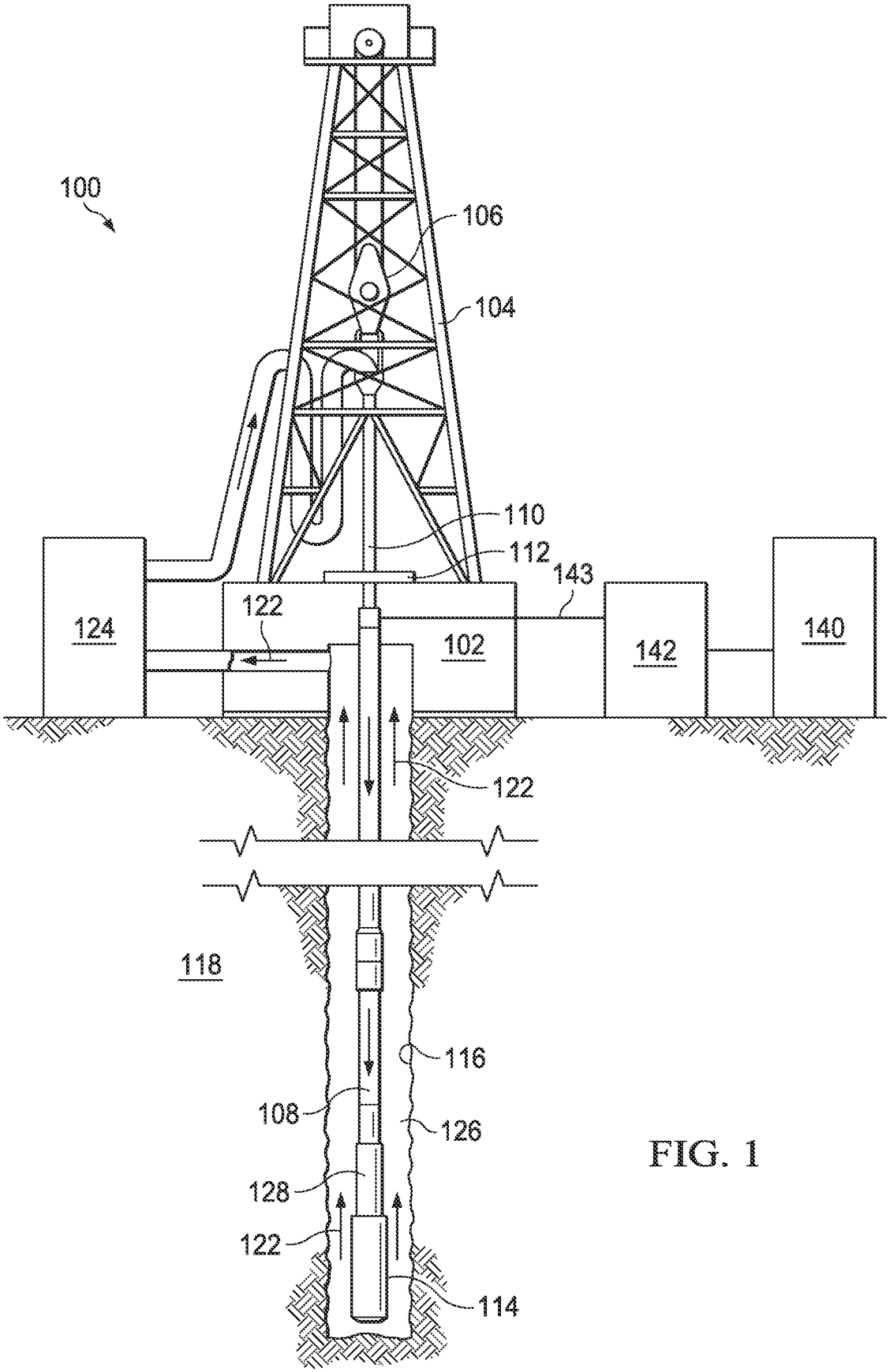
FIG. 1 illustrates an elevation view of an exemplary downhole electrocrushing drilling system used in a wellbore environment.

FIG. 1 is an elevation view of an exemplary electrocrushing drilling system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 116 is shown as being a generally vertical wellbore, wellbore 116 may be any orientation including generally horizontal, multilateral, or directional.

Drilling system 100 includes drilling platform 102 that supports derrick 104 having traveling block 106 for raising and lowering drill string 108. Drilling system 100 also includes pump 124, which circulates electrocrushing drilling fluid 122 through a feed pipe to drill string 110, which in turn conveys electrocrushing drilling fluid 122 downhole through interior channels of drill string 108 and through one or more orifices in electrocrushing drill bit 114. Electrocrushing drilling fluid 122 then circulates back to the surface via annulus 126 formed between drill string 108 and the sidewalls of wellbore 116. Fractured portions of the formation are carried to the surface by electrocrushing drilling fluid 122 to remove those fractured portions from wellbore 116.

Electrocrushing drill bit 114 is attached to the distal end of drill string 108. In some embodiments, power to electrocrushing drill bit 114 may be supplied from the surface. For example, generator 140 may generate electrical power and provide that power to power-conditioning unit 142. Power-conditioning unit 142 may then transmit electrical energy downhole via surface cable 143 and a sub-surface cable (not expressly shown in FIG. 1) contained within drill string 108 or attached to the side of drill string 108. A pulse-generating circuit within bottom-hole assembly (BHA) 128 may receive the electrical energy from power-conditioning unit 142, and may generate high-energy pulses to drive electrocrushing drill bit 114.

The pulse-generating circuit within BHA 128 may be utilized to repeatedly apply a high electric potential, for example up to or exceeding 150 kV, across the electrodes of electrocrushing drill bit 114. Each application of electric potential may be referred to as a pulse. When the electric potential across the electrodes of electrocrushing drill bit 114 is increased enough during a pulse to generate a sufficiently high electric field, an electrical arc forms through a rock formation at the bottom of wellbore 116. The arc temporarily forms an electrical coupling between the electrodes of electrocrushing drill bit 114, allowing electric current to flow through the arc inside a portion of the rock formation at the bottom of wellbore 116. This electric current flows until the energy in a given pulse is dissipated. The arc greatly increases the temperature and pressure of the portion of the rock formation through which the arc flows and the surrounding formation and materials. The temperature and pressure are sufficiently high to break the rock into small pieces. The vaporization process creates a high-pressure gas which expands and, in turn, fractures the surrounding rock. This fractured rock is removed, typically by electrocrushing drilling fluid 122, which moves the fractured rock away from the electrodes and uphole.

As electrocrushing drill bit 114 repeatedly fractures the rock formation and electrocrushing drilling fluid 122 moves the fractured rock uphole, wellbore 116, which penetrates various subterranean rock formations 118, is created. Wellbore 116 may be any hole drilled into a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole drilled into a subterranean formation or series of subterranean formations for the purpose of geothermal power generation.

Although drilling system 100 is described herein as utilizing electrocrushing drill bit 114, drilling system 100 may also utilize an electrohydraulic drill bit. An electrohydraulic drill bit may have multiple electrodes similar to electrocrushing drill bit 114. But, rather than generating an arc within the rock, an electrohydraulic drill bit applies a large electrical potential across two electrodes to form an arc across the drilling fluid proximate the bottom of wellbore 116. The high temperature of the arc vaporizes the portion of the fluid immediately surrounding the arc, which in turn generates a high-energy shock wave in the remaining fluid. The electrodes of electrohydraulic drill bit may be oriented such that the shock wave generated by the arc is transmitted toward the bottom of wellbore 116. When the shock wave hits and bounces off of the rock at the bottom of wellbore 116, the rock fractures. Accordingly, drilling system 100 may utilize pulsed-power technology with an electrohydraulic drill bit to drill wellbore 116 in subterranean formation 118 in a similar manner as with electrocrushing drill bit 114.

Figure 2:
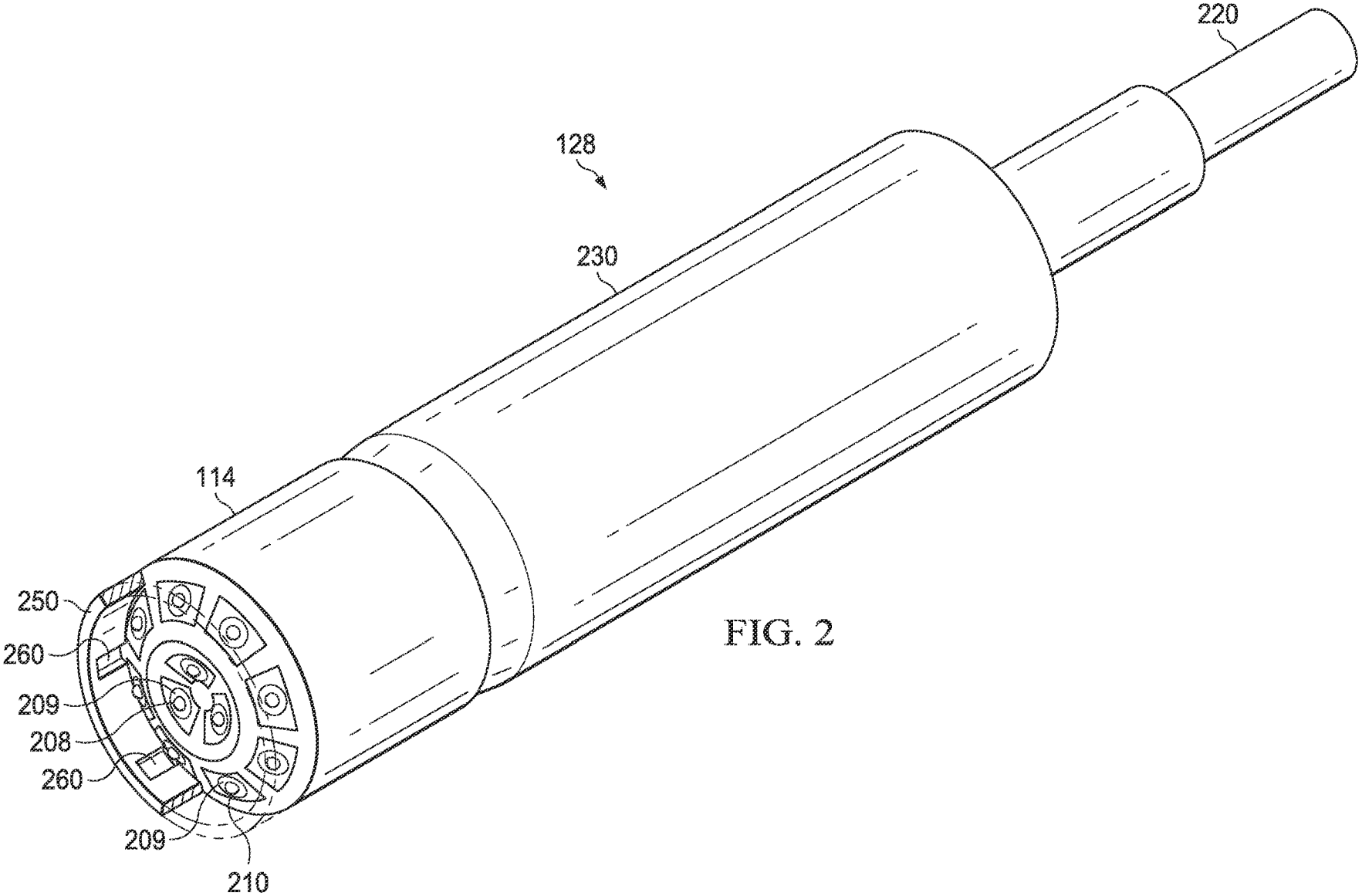
FIG. 2 illustrates exemplary components of a bottom hole assembly for a downhole electrocrushing drilling system.

FIG. 2 illustrates exemplary components of the bottom hole assembly for downhole electrocrushing drilling system 100. Bottom-hole assembly (BHA) 128 may include pulsed-power tool 230. BHA 128 may also include electrocrushing drill bit 114. For the purposes of the present disclosure, electrocrushing drill bit 114 may be referred to as being integrated within BHA 128, or may be referred to as a separate component that is coupled to BHA 128.

Pulsed-power tool 230 may be coupled to provide pulsed power to electrocrushing drill bit 114. Pulsed-power tool 230 receives electrical energy from a power source via cable 220. For example, pulsed-power tool 230 may receive power via cable 220 from a power source on the surface as described above with reference to FIG. 1, or from a power source located downhole such as a generator powered by a mud turbine. Pulsed-power tool 230 may also receive power via a combination of a power source on the surface and a power source located downhole. Pulsed-power tool 230 converts the electrical energy received from the power source into high-power electrical pulses, and may apply those high-power pulses across electrode 208 and ground ring 250 of electrocrushing drill bit 114. Pulsed-power tool 230 may also apply high-power pulses across electrode 210 and ground ring 250 in a similar manner as described herein for electrode 208 and ground ring 250. Pulsed-power tool 230 may include a pulse-generating circuit as described below with reference to FIG. 3.

Referring to FIG. 1 and FIG. 2, electrocrushing drilling fluid 122 may exit drill string 108 via openings 209 surrounding each electrode 208 and each electrode 210. The flow of electrocrushing drill fluid 122 out of openings 209 allows electrodes 208 and 210 to be insulated by the electrocrushing drilling fluid. In some embodiments, electrocrushing drill bit 114 may include a solid insulator (not expressly shown in FIG. 1 or 2) surrounding electrodes 208 and 210 and one or more orifices (not expressly shown in FIG. 1 or 2) on the face of electrocrushing drill bit 114 through which electrocrushing drilling fluid 122 may exit drill string 108. Such orifices may be simple holes, or they may be nozzles or other shaped features. Because fines are not typically generated during electrocrushing drilling, as opposed to mechanical drilling, electrocrushing drilling fluid 122 may not need to exit the drill bit at as high a pressure as the drilling fluid in mechanical drilling. As a result, nozzles and other features used to increase drilling fluid pressure may not be needed. However, nozzles or other features to increase electrocrushing drilling fluid 122 pressure or to direct electrocrushing drilling fluid may be included for some uses.

Drilling fluid 122 is typically circulated through drilling system 100 at a flow rate sufficient to remove fractured rock from the vicinity of electrocrushing drill bit 114 in sufficient quantities within a sufficient time to allow the drilling operation to proceed downhole at least at a set rate. In addition, electrocrushing drilling fluid 122 may be under sufficient pressure at a location in wellbore 116, particularly a location near a hydrocarbon, gas, water, or other deposit, to prevent a blowout.

Electrodes 208 and 210 may be at least 0.4 inches apart from ground ring 250 at their closest spacing, at least 1 inch apart at their closest spacing, at least 1.5 inches apart at their closest spacing, or at least 2 inches apart at their closest spacing. If drilling system 100 experiences vaporization bubbles in electrocrushing drilling fluid 122 near electrocrushing drill bit 114, the vaporization bubbles may have deleterious effects. For instance, vaporization bubbles near electrodes 208 or 210 may impede formation of the arc in the rock. Electrocrushing drilling fluids 122 may be circulated at a flow rate also sufficient to remove vaporization bubbles from the vicinity of electrocrushing drill bit 114.

In addition, electrocrushing drill bit 114 may include ground ring 250, shown in part in FIG. 2. Although not all electrocrushing drill bits 114 may have ground ring 250, if it is present, it may contain passages 260 to permit the flow of electrocrushing drilling fluid 122 along with any fractured rock or bubbles away from electrodes 208 and 210 and uphole.

Figure 3:
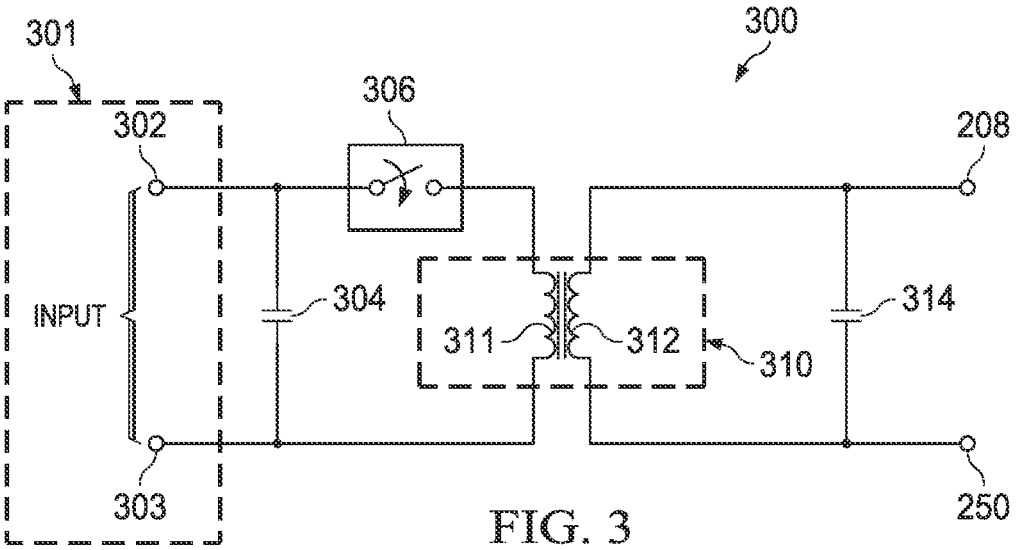
FIG. 3 illustrates a schematic for an exemplary pulse-generating circuit for a downhole electrocrushing drilling system.

FIG. 3 illustrates a schematic for an exemplary pulse-generating circuit for a downhole electrocrushing drilling system. Pulse-generating circuit 300 may include power source input 301, including input terminals 302 and 303, and capacitor 304 coupled between input terminals 302 and 303. Pulse-generating circuit 300 may also include switching circuit 306, transformer 310, and capacitor 314.

As described above with reference to FIG. 2, power source input 301 may receive electrical energy from a power source located on the surface or located downhole. Pulse-generating circuit 300 may convert the received energy into high-power electrical pulses that are applied across electrodes 208 or electrodes 210 and ground ring 250 of electrocrushing drill bit 114. As described above with reference to FIG. 1 and FIG. 2, the high-power electrical pulses at the electrodes are utilized to drill wellbore 116 in subterranean formation 118.

Switching circuit 306 may include any suitable device to open and close the electrical path between power source input 301 and the first winding 311 of transformer 310. For example, switching circuit 306 may include a mechanical switch, a solid-state switch, a magnetic switch, a gas switch, or any other type of switch suitable to open and close the electrical path between power source input 301 and first winding 311 of transformer 310. Switching circuit 306 may be open between pulses. When switching circuit 306 is closed, electrical current flows through first winding 311 of transformer 310. Second winding 312 of transformer 310 may be electromagnetically coupled to first winding 311. Accordingly, transformer 310 generates a current through second winding 312 when switching circuit 306 is closed and current flows through first winding 311. In some embodiments, one or both of first winding 311 and second winding 312 may include multiple magnetically coupled windings that are coupled in series or in parallel. For example, second winding 312 may include multiple individual windings that are coupled in series to increase the voltage across second winding 312. As another example, second winding 312 may include multiple individual windings that are coupled in parallel to increase the current provided by second winding 312 for a given current through first winding 311. Similarly, transformer 310 may include multiple isolated transformers with their respective outputs coupled in series to produce a higher voltage output, or with their outputs coupled in parallel to produce a higher current output.

The current through second winding 312 charges capacitor 314, thus increasing the voltage across capacitor 314. Electrode 208 and ground ring 250 may be coupled to opposing terminals of capacitor 314. Accordingly, as the voltage across capacitor 314 increases, the voltage across electrode 208 and ground ring 250 increases. And, as described above with reference to FIG. 1, when the voltage across the electrodes of an electrocrushing drill bit becomes sufficiently large, an arc forms through a rock formation that is in contact with electrode 208 and ground ring. The arc provides a temporary electrical short between electrode 208 and ground ring 250, and thus discharges, at a high current level, the voltage built up across capacitor 314. As described above with reference to FIG. 1, the arc greatly increases the temperature of the portion of the rock formation through which the arc flows and the surrounding formation and materials. The temperature is sufficiently high to vaporize any water or other fluids that might be touching or near the arc and may also vaporize part of the rock itself. The vaporization process creates a high-pressure gas which expands and, in turn, fractures the surrounding rock Although FIG. 3 illustrates a schematic for a particular pulse-generating circuit topology, electrocrushing drilling systems and pulsed-power tools may utilize any suitable pulse-generating circuit topology to generate and apply high-voltage pulses to across electrode 208 and ground ring 250. Such pulse-generating circuit topologies may utilize one or more switching circuits such as switching circuit 306. Moreover, although FIG. 3 illustrates switching circuit 306 implemented within a particular pulse-generating circuit 300, the switches described herein may be utilized within any other type of pulse-generating circuit, within any other pulsed-power tool, or within any other suitable application implementing high-voltage switches.

Figure 4:
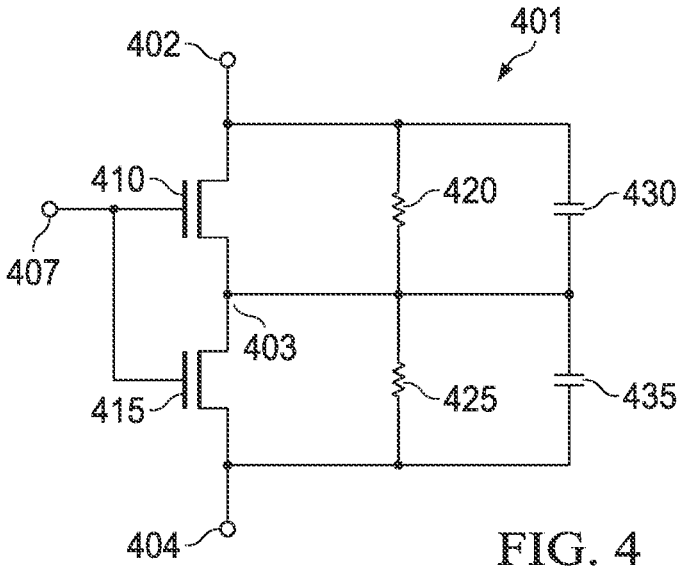
FIG. 4 illustrates a schematic for an exemplary switching circuit for a downhole electrocrushing drilling system.

FIG. 4 illustrates a schematic for an exemplary switching circuit for a downhole electrocrushing drilling system. Switching circuit 401 may be implemented with one or more solid state switches. For example, switching circuit 401 may be implemented with solid-state switch 410 and solid-state switch 415. As illustrated in FIG. 4, solid-state switches 410 and 415 may be controlled by a control signal at terminal 407. When activated, solid-state switches 410 and 415 pass an electrical current between terminals 402 and 404.

As shown in FIG. 4, switching circuit 401 may be implemented with solid-state switches 410 and 415 coupled in series with each other between terminals 402 and 404. Switching circuit 401 may also be implemented with any suitable number of solid-state switches coupled in series and/or in parallel between terminals 402 and 404. For example, switching circuit 401 may include one, two, four, ten, or more solid-state switches coupled in series between terminals 402 and 404. Moreover, one, two, four, ten, or more additional solid-state switches may be coupled in parallel with each respective solid-state switch that is coupled in series between terminals 402 and 404.

Switching circuit 401 may be configured to handle high voltages and high currents present in a pulsed-power system for downhole electrocrushing drilling. For example, switching circuit 401 may be configured to operate with up to 40 kV or more across terminals 402 and 404. Further, switching circuit 401 may be configured to pass up to 10 kA or more when activated. The voltage rating of switching circuit 401 may be based on the number of solid-state devices coupled in series between terminals 402 and 404. For example, as shown in FIG. 4, solid-state switches 410 and 415 may be coupled in series with each other between terminals 402 and 404. Accordingly, each of solid-state switch 410 and solid-state switch 415 may have a voltage rating of up to 20 kV or more to provide switching circuit 401 with a total voltage rating of up to 40 kV or more. The current rating of switching circuit 401 may be based on the number of solid-state devices coupled in parallel along the path between terminals 402 and 404. Thus, each of solid-state switches 410 and 415 shown in FIG. 4 may have a current rating of 10 kA to provide switching circuit 401 with a current rating of 10 kA. In other implementations of switching circuit 401, one or more solid-state switches with current ratings of less than 10 kA may be placed in parallel to achieve a total current rating of 10 kA or more.

Switching circuit 401 may also include grading resistors. For example, switching circuit 401 may include resistor 420 and resistor 425. Resistor 420 may be coupled in parallel with solid-state switch 410 between terminals 402 and 403. Similarly, resistor 425 may be coupled in parallel to solid-state switch 415 between terminals 403 and 404. Resistors 420 and 425 grade the voltage across terminals 402 and 404 such that the voltage across terminals 402 and 404 of switching circuit 401 is evenly divided across solid-state switch 410 and solid-state switch 415. Switching circuit 401 may also include capacitor 430 coupled in parallel with solid-state switch 410, and capacitor 435 coupled in parallel with solid-state switch 415. Accordingly, capacitor 430 dampens any transient voltage spikes across solid-state switch 410 that occurs during operation of switching circuit 401. Likewise, capacitor 435 dampens any transient voltage spikes across solid-state switch 415 that occurs during operation of switching circuit 401. Such devices that dampen transient voltages may also be referred to as j jail protection circuits or as snubber circuits.

Solid-state switches 410 and 415, and any other solid-state switches utilized in switching circuit 401, may be implemented with any suitable type of solid-state switch. For example, the solid-state switches 410 and 415 implemented in switching circuit 401 may be silicon-carbide or gallium-arsenide switches. Such solid-state switches are capable of withstanding the high voltages and the high currents utilized in the pulsed-power system. Moreover, such solid-state switches are capable of withstanding harsh environment of a downhole pulsed-power system. The solid-state switches may operate over a wide temperature range (for example, from 10 to 150 degrees Centigrade or from 10 to 200 degrees Centigrade), and may physically withstand the vibration and mechanical shock resulting from the fracturing of rock during downhole electrocrushing drilling. Solid-state switches 410 and 415 may also be silicon switches, which may operate of a temperate range of 10 to 125 degrees Centigrade and may physically withstand the vibration and mechanical shock resulting from the fracturing of rock during downhole electrocrushing drilling.

Figure 5:
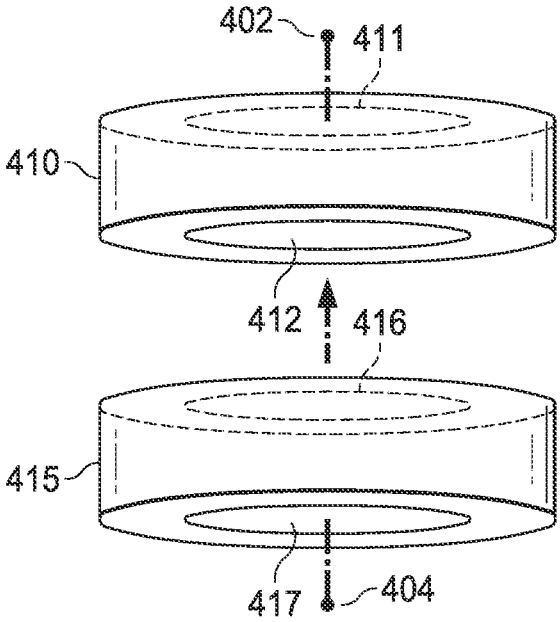
FIG. 5 illustrates a side expanded view of certain components of an exemplary switching circuit for a downhole electrocrushing drilling system.

FIG. 5 illustrates a side expanded view of certain components of an exemplary switching circuit for a downhole electrocrushing drilling system. As described above with reference to FIG. 4, switching circuit 401 may include solid-state switch 410 coupled in series with solid-state switch 415. As shown in FIG. 5, solid-state switch 410 may be implemented in a disc shape with contact 411 located on a first side of the disc and contact 412 located on an opposing side of the disc. Similarly, solid-state switch 415 may be implemented in a disc shape with contact 416 located on a first side of the disc and contact 417 located on an opposing side of the disc. Contact 411 of solid-state switch 410 electrically couples to terminal 402 of switching circuit 401, and contact 417 of solid-state switch 415 electrically couples to terminal 404 of switching circuit 401. Further, solid-state switch 410 and solid-state switch 415 may be mechanically clamped together such that contact 412 of solid-state switch 410 electrically couples directly to contact 416 of solid-state switch 415. Accordingly, any parasitic resistance due to the coupling between solid-state switch 410 and solid-state switch 415 is minimized.

Figure 6:
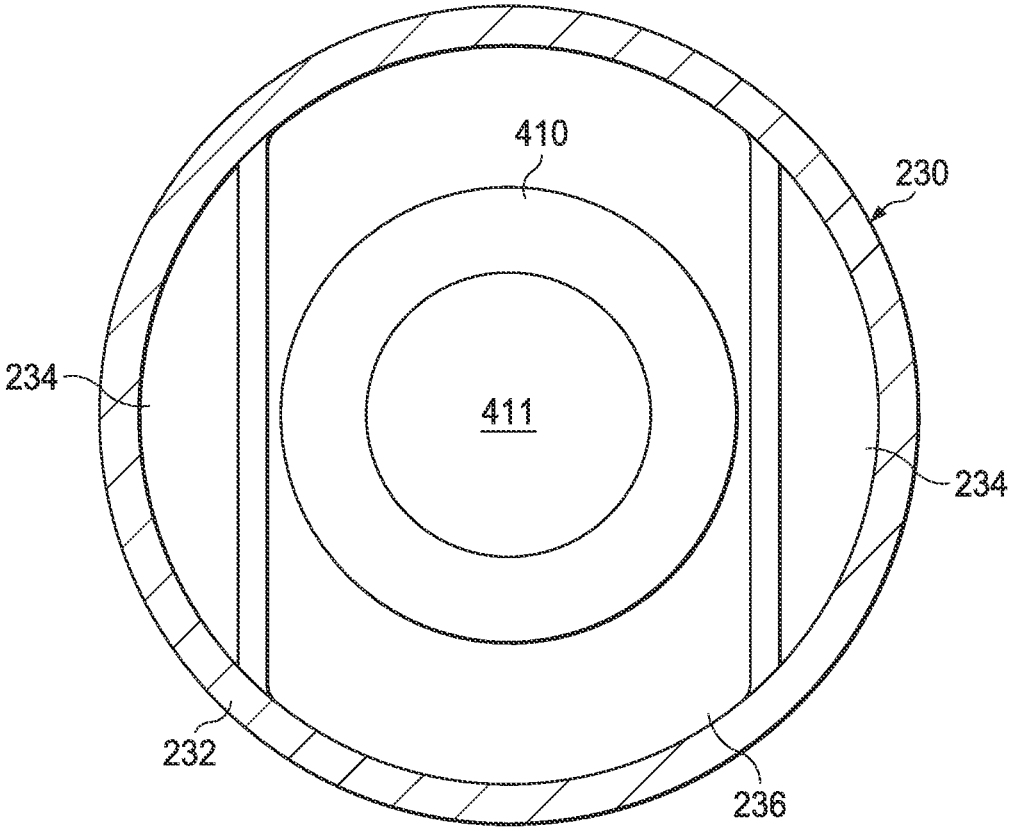
FIG. 6 illustrates a top cross-sectional view of an exemplary pulsed-power tool for a downhole electrocrushing drilling system.

FIG. 6 illustrates a top cross-sectional view of an exemplary pulsed-power tool for a downhole electrocrushing drilling system. Pulsed-power tool 230 includes outer pipe 232 that forms a section of an outer wall of a drill string (for example, drill string 108 illustrated in FIG. 1). As shown in the top cross-sectional view of FIG. 6, solid-state switch 410 of switching circuit 401 is sized and shaped to fit within pulsed-power tool 230, which as described above with reference to FIG. 2, may form part of BHA 128. Although not expressly shown in the top cross-sectional view of FIG. 6, other components of switching circuit 401 (for example, other solid-state switches, grading resistors, capacitors) may also be shaped to fit within pulsed-power tool 230. For example, components of switching circuit 401 may fit within inner channel 236 of pulsed-power tool 230.

The downhole electrocrushing drilling system in which pulsed-power tool 230 is incorporated may be configured to drill, for example, eight-and-a-half inch wellbores. The outer diameter of pulsed-power tool 230 may have a smaller outer diameter than the wellbore. As an example, for an eight-and-a-half inch wellbore, pulsed-power tool 230 may have a seven-and-a-half inch outer diameter. Further, pulsed-power tool 230 includes one or more fluid channels 234 within the circular cross-section of outer pipe 232, through which drilling fluid 122 passes as the fluid is pumped down through a drill string (for example, drill string 108) as described above with reference to FIG. 1. Accordingly, to fit within inner channel 236 of pulsed-power tool 230, some embodiments of solid-state switch 410 may have a diameter of approximately five to six inches. In some embodiments, the components of switching circuit 401 such as solid-state switch 410 may have a smaller or larger size depending on the diameter of the wellbore, the corresponding outer diameter of pulsed-power tool 230, and the size of inner channel 236.

Figure 7:
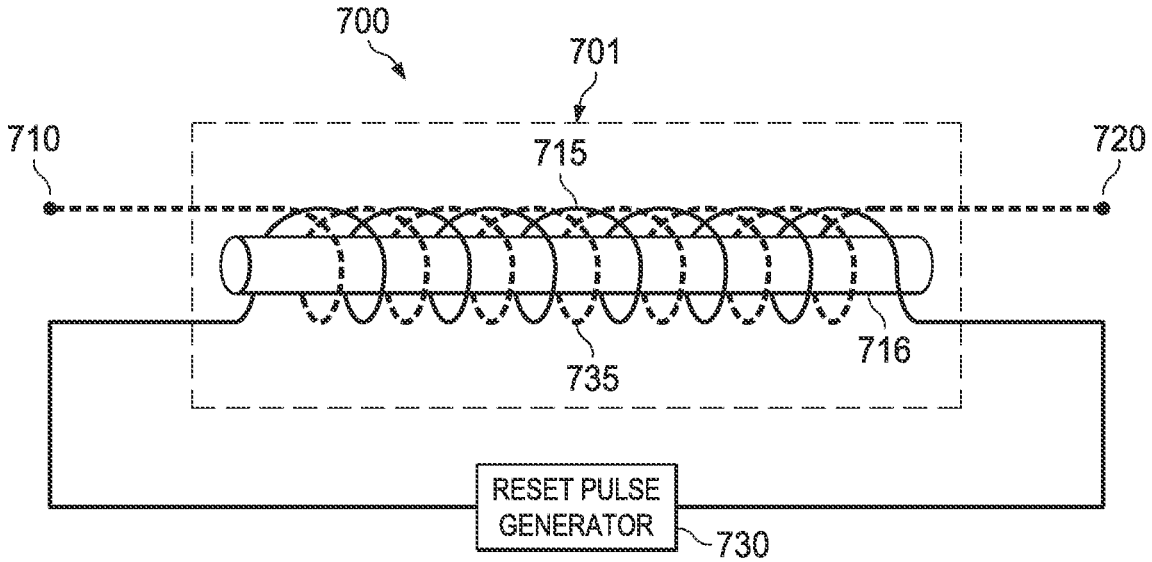
FIG. 7 illustrates a schematic for an exemplary switching circuit for a downhole electrocrushing drilling system.

FIG. 7 illustrates a schematic for an exemplary switching circuit for a downhole electrocrushing drilling system. Switching circuit 700 includes magnetic switch 701 coupled between terminals 710 and 720. Magnetic switch 701 includes primary coil 715, secondary coil 735, and core 716.

Primary coil 715 and core 716 operates as a magnetic switch by alternating between providing a small inductance value and a large inductance value depending on whether core 716 is saturated or not saturated. The inductance of magnetic switch 701 is represented by the following equation:

$$L=\mu_o*\mu*n^2*L*A \quad \text{(Equation 1):}$$

where $\mu_o$ equals the permeability of free space (i.e., $8.85*10^{-12}$ farads/meter), μ equals relative permeability, n equals the number of turns of primary coil 715 per meter, L equals the length of primary coil 715 in meters, and A equals the cross section area of the primary coil 715 in square meters. Core 716 includes a magnetic material that has a high relative permeability (for example, from two-thousand gausses up to ten-thousand gausses or more) when core 716 is not saturated, and a low relative permeability (for example, approximately one gauss) when core 716 is saturated. For example, core 716 may include a cobalt-iron alloy such as supermendur, which may include approximately forty-eight percent cobalt, approximately forty-eight percent iron, and approximately two percent vanadium by weight. The supermendur material maintains its high relative permeability across a wide range of temperatures (for example, from 10 to 150 degrees Centigrade or from 10 to 200 degrees Centigrade), and thus withstands the high temperatures of a downhole environment. As other examples, core 716 may include a ferrite material or Metglas, which includes a thin amorphous metal alloy ribbon which may be magnetized and demagnetized.

In operation, a switching cycle of magnetic switch 701 begins with core 716 in a non-saturated state. In the non-saturated state, magnetic switch 701 has a large inductance (for example, 50 to 400 mH). A voltage ramp is then be applied to terminal 710. The current in the magnetic switch rises according to the following equation:

$$dI/dt=V/L \quad \text{(Equation 2):}$$

where dI/dt equals the rise in current over time, V is the voltage applied to magnetic switch 701, and L is the inductance of magnetic switch 701. As shown by Equation 2, the large inductance of magnetic switch 701 will cause the current through magnetic switch 701 to rise slowly over time. After a period of time, the voltage-time product (for example, the voltage across magnetic switch 701 multiplied by the time of the voltage ramp) increases to a value at which the magnetic material of core 716 saturates. When the magnetic material of core 716 saturates, the relatively permeability of core 716 decreases down to, for example, approximately one gauss. Thus, according to Equation 1 above, the inductance of magnetic switch 701 also decreases. For example, magnetic switch 701 may have an inductance that drops to approximately 5 to 50 uH when core 716 saturates. In accordance with Equation 2, the current through magnetic switch 701 begins to rise more quickly when the inductance of magnetic switch 701 decreases. Accordingly, when core 716 saturates, magnetic switch 701 operates as a closed switch, and the electrical energy at terminal 710 is rapidly transferred to terminal 720.

As shown in FIG. 7, magnetic switch 701 includes secondary coil 735 in addition to primary coil 715. Secondary coil 735 is coupled to reset-pulse generator 730, which is configured to provide a reset signal to secondary coil 735. For example, reset-pulse generator 730 may provide a pulsed reset waveform. Reset-pulse generator 730 may also be referred to more generally as a reset generator and may provide either a pulsed reset waveform or a constant current for a period of time through secondary coil 735, either of which may cause core 716 to come out of saturation. When core 716 returns to a non-saturated state, the inductance of magnetic switch 701 returns to a high value, and thus operate as an open switch. Although FIG. 7 illustrates reset-pulse generator 730 coupled to secondary coil 735 to provide a reset pulse that pulls core 716 out of saturation, a reset pulse may be applied to magnetic switch 701 in any suitable manner. For example, a reset pulse may also be applied directly to primary coil 715 to pull core 716 out of saturation.

In some embodiments of a downhole electrocrushing drilling system, each of the switching circuits utilized in a pulse-generating circuit, such as pulse-generating circuit 300 illustrated in FIG. 3, may include magnetic switches such as magnetic switch 701 illustrated in FIG. 7. In such embodiments, the pulse-generating circuit may be free of solid-state switches. The magnetic switches described herein may withstand the harsh environment of the downhole drilling system. Thus, the use of magnetic switches may further improve the mean time to failure (MTTF) of pulse-generating circuits, and the time and costs of repairs may be reduced.

Figure 8:
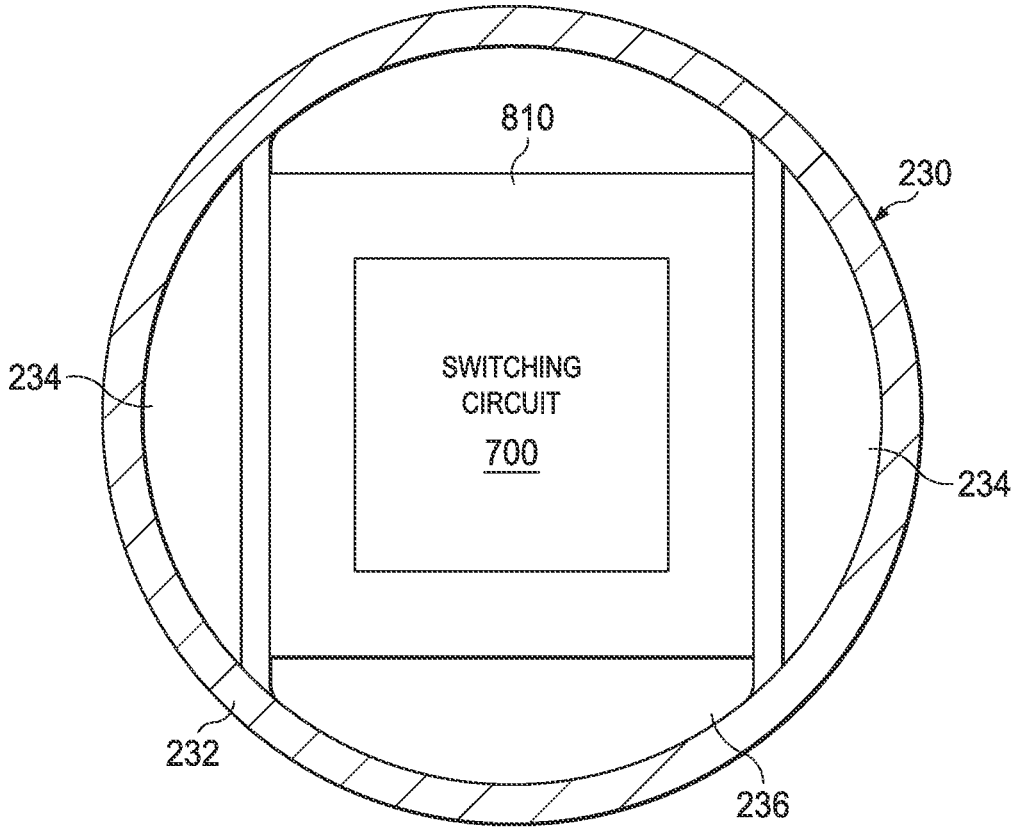
FIG. 8 illustrates a top cross-sectional view of an exemplary pulsed-power tool for a downhole electrocrushing drilling system.

FIG. 8 illustrates a top cross-sectional view of an exemplary pulsed-power tool for a downhole electrocrushing drilling system. Switching circuit 700 may serve, for example, as a switching circuit in a pulse-generating circuit similar to switching circuit 306 in pulse-generating circuit 300 depicted in FIG. 3. Switching circuit 700 may be shaped and sized to fit within the circular cross-section of pulsed-power tool 230, which as described above with reference to FIG. 2, may form part of BHA 128. For example, switching circuit 700 may be shaped and sized to fit within inner channel 236. Moreover, switching circuit 700 may be enclosed within encapsulant 810. Encapsulant 810 includes a thermally conductive material. For example, encapsulant 810 may include APTEK 2100-A/B, which is a two component, unfilled, electrically insulating urethane system for the potting and encapsulation of electronic components, and may have a thermal conductivity of 0.17 W/mK. Encapsulant 810 adjoins an outer wall of one or more fluid channels 234. As described above with reference to FIG. 1, drilling fluid 122 passes through fluid channels 234 as drilling fluid is pumped down through a drill string. Encapsulant 810 transfers heat generated by switching circuit 700 to the drilling fluid that passes through fluid channels 234. Thus, encapsulant 810 prevents switching circuit 700 from overheating to a temperature that degrades the relative permeability of core 716 (shown in FIG. 7) within switching circuit 700 when core 716 is in a non-saturated state.

Figure 9:
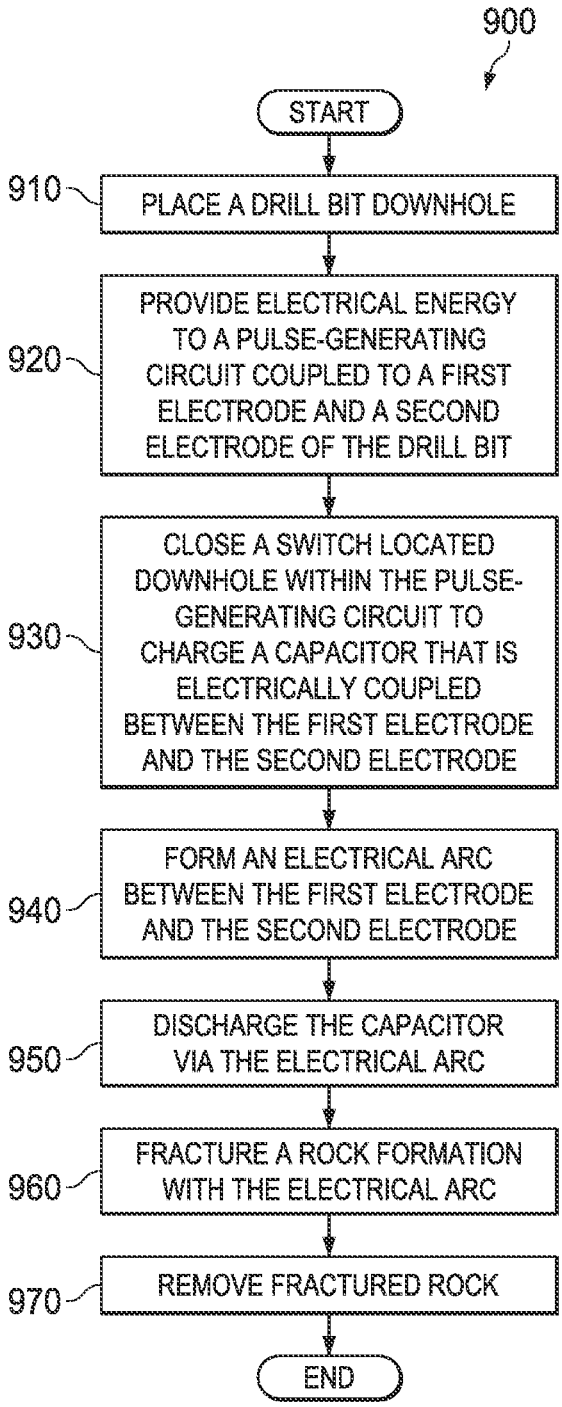
FIG. 9 illustrates a flow chart of exemplary method for drilling a wellbore.

FIG. 9 illustrates a flow chart of exemplary method for drilling a wellbore.

Method 900 may begin and at step 910 a drill bit may be placed downhole in a wellbore. For example, drill bit 114 may be placed downhole in wellbore 116 as shown in FIG. 1.

At step 920, electrical power may be provided to a pulse-generating circuit coupled to a first electrode and a second electrode of the drill bit. For example, as described above with reference to FIG. 3, pulse-generating circuit 300 may be implemented within pulsed-power tool 230 of FIG. 2. And as described above with reference to FIG. 2, pulsed-power tool 230 may receive power from a power source on the surface, from a power source located downhole, or from a combination of a power source on the surface and a power source located downhole. The power may be provided to pulse-generating circuit 400 within pulse-power tool 230 at power source input 301. As further shown in FIGS. 2 and 3, the pulse generating circuit may be coupled to a first electrode (such as electrode 208) and a second electrode (such as ground ring 250) of drill bit 114.

At step 930, a switch located downhole within the pulse-generating circuit may close to charge a capacitor that is electrically coupled between the first electrode and the second electrode. For example, switching circuit 306 may close to generate an electrical pulse and may be open between pulses. Switching circuit 306 may include a solid-state switch (such as solid-state switches 410 and 415 of FIG. 4) or a magnetic switch (such as magnetic switch 701 of FIG. 7). As described above with reference to FIG. 3, switching circuit 306 may switch to close the electrical path between power source input 301 and the first winding 311 of transformer 310. When switching circuit 306 is closed, electrical current flows through first winding 311 of transformer 310. Second winding 312 of transformer 310 may be electromagnetically coupled to first winding 311. Accordingly, transformer 310 generates a current through second winding 312 when switching circuit 306 is closed and current flows through first winding 311. The current through second winding 312 charges capacitor 314, thus increasing the voltage across capacitor 314. Capacitor 314 of pulse-generating circuit 300 may be coupled between a first electrode (such as electrode 208) and a second electrode (such as ground ring 250) of drill bit 114. Accordingly, as the voltage across capacitor 314 increases, the voltage across electrode 208 and ground ring 250 increases.

At step 940, an electrical arc may be formed between the first electrode and the second electrode of the drill bit. And at step 950, the capacitor may discharge via the electrical arc. For example, as the voltage across capacitor 314 increases during step 930, the voltage across electrode 208 and ground ring 250 also increases. As described above with reference to FIGS. 1 and 2, when the voltage across electrode 208 and ground ring 250 becomes sufficiently large, an arc may form through a rock formation that is in contact with electrode 208 and ground ring 250. The arc may provide a temporary electrical short between electrode 208 and ground ring 250, and thus may discharge, at a high current level, the voltage built up across capacitor 314.

At step 960, the rock formation at an end of the wellbore may be fractured with the electrical arc. For example, as described above with reference to FIGS. 1 and 2, the arc greatly increases the temperature of the portion of the rock formation through which the arc flows as well as the surrounding formation and materials. The temperature is sufficiently high to vaporize any water or other fluids that may be touching or near the arc and may also vaporize part of the rock itself. The vaporization process creates a high-pressure gas which expands and, in turn, fractures the surrounding rock.

At step 970, fractured rock may be removed from the end of the wellbore. For example, as described above with reference to FIG. 1, electrocrushing drilling fluid 122 may move the fractured rock away from the electrodes and uphole away from the bottom of wellbore 116.

Subsequently, method 900 may end. Modifications, additions, or omissions may be made to method 900 without departing from the scope of the disclosure. For example, the order of the steps may be performed in a different manner than that described and some steps may be performed at the same time. Additionally, each individual step may include additional steps without departing from the scope of the present disclosure.

Embodiments herein may include:

A. A downhole drilling system including a bottom-hole assembly having a pulse-generating circuit and a switching circuit within the pulse-generating circuit. The switching circuit includes a solid-state switch. The downhole drilling system also includes a drill bit having a first electrode and a second electrode electrically coupled to the pulse-generating circuit to receive a pulse from the pulse-generating circuit.

B. A downhole drilling system including a bottom-hole assembly having a pulse-generating circuit and a switching circuit within the pulse-generating circuit. The switching circuit includes a magnetic switch. The downhole drilling system also includes a drill bit having a first electrode and a second electrode electrically coupled to the pulse-generating circuit to receive a pulse from the pulse-generating circuit.

C. A method, including placing a drill bit downhole in a wellbore and providing electrical power to a pulse-generating circuit coupled to a first electrode and a second electrode of the drill bit. The method also includes closing a switch located downhole within the pulse-generating circuit to charge a capacitor that is electrically coupled between the first electrode and the second electrode, forming an electrical arc between the first electrode and the second electrode of the drill bit, and discharging the capacitor via the electrical arc. Further, the method includes fracturing a rock formation at an end of the wellbore with the electrical arc and removing fractured rock from the end of the wellbore.

Each of embodiments A and B may have one or more of the following additional elements in any combination:

Element 1: wherein the solid-state switch is a silicon-carbide switch. Element 2: wherein the solid-state switch is one of a gallium-arsenide switch and a silicon switch. Element 3: wherein the solid-state switch is located within a circular cross-section of the bottom-hole assembly. Element 4: wherein the switching circuit includes a plurality of solid-state switches coupled together in parallel. Element 5: wherein the switching circuit includes a plurality of solid-state switches coupled together in series. Element 6: wherein the switching circuit further includes an additional solid-state switch coupled in parallel with each respective solid-state switch of the plurality of solid-state switches coupled together in series. Element 7: wherein the downhole drilling system further includes a plurality of grading resistors, each of the plurality of grading resistors coupled in parallel to a corresponding solid-state switch of the plurality of solid-state switches. Element 8: wherein the downhole drilling system further includes a plurality of capacitors, each of the plurality of capacitors coupled in parallel to a corresponding solid-state switch of the plurality of solid-state switches. Element 9: wherein the drill bit is one of an electrocrushing drill bit and an electrohydraulic drill bit. Element 10: wherein the magnetic switch includes a primary coil and a supermendur core. Element 11: wherein the magnetic switch includes a primary coil and a Metglas core. Element 12: wherein the pulse-generating circuit includes a plurality of switching circuits, each of the plurality of switching circuits including a magnetic switch. Element 13: wherein the downhole drilling system further includes a reset generator coupled to the magnetic switch. Element 14: wherein the magnetic switch further includes a secondary coil coupled to receive a constant current from the reset generator to transition the core from a saturated state to a non-saturated state. Element 15: wherein the magnetic switch further includes a secondary coil coupled to receive a reset pulse from the reset generator to transition the core from a saturated state to a non-saturated state. Element 16: wherein the magnetic switch is located within a circular cross-section of the bottom-hole assembly. Element 17: wherein the downhole drilling system further includes a thermally conductive encapsulant surrounding the magnetic switch. Element 18: wherein the thermally conductive encapsulant adjoins the outer wall of a drilling fluid channel within the circular cross-section of the bottom-hole assembly. Element 19: wherein the drill bit is integrated within the bottom-hole assembly. Element 20: wherein a reset pulse is applied to a secondary coil of the magnetic switch to transition the core from a saturated state to a non-saturated state. Element 21: wherein a constant current is applied to a secondary coil of the magnetic switch to transition the core from a saturated state to a non-saturated state.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A downhole drilling system, comprising:

a bottom-hole assembly including a pulse-generating circuit including a transformer including a pulse-generating core;

a primary winding electrically coupled with the pulse-generating core and electrically coupled to receive a switch-transformed electrical current; and a secondary winding to output a pulse-generating transformed electrical current that is derived from the switch-transformed electrical current flowing in the primary winding; and a magnetic switch electrically coupled with the primary winding of the transformer, the magnetic switch including a switch core;

a primary coil electrically coupled with a power source, the transformer, and the switch core, wherein the primary coil is to receive an input electrical current from the power source;

a secondary coil electrically coupled with the switch core, wherein the secondary coil is to output the switch-transformed electrical current to the primary winding of the transformer that is derived from the input electrical current flowing in the primary coil; and a reset-pulse generator that is configured to transmit, via at least one of the secondary coil or the primary coil, a current to move the switch core from a saturated state to an unsaturated state such that the magnetic switch is returned to being opened in response to the switch core moving to the unsaturated state; and a drill bit including a first electrode and a second electrode electrically coupled to the pulse-generating circuit to receive a pulse from the pulse-generating circuit.

2. The downhole drilling system of claim 1, wherein the switch core is a supermendur core.

3. The downhole drilling system of claim 1, wherein the switch core is a Metglas core.

4. The downhole drilling system of claim 1, wherein the pulse-generating circuit includes a plurality of switching circuits, each of the plurality of switching circuits comprising a respective magnetic switch.

5. The downhole drilling system of claim 1, wherein the current from the reset-pulse generator is a constant current.

6. The downhole drilling system of claim 1, wherein the current from the reset-pulse generator is a pulsed waveform.

7. The downhole drilling system of claim 1, wherein the magnetic switch is located within a circular cross-section of the bottom-hole assembly.

8. The downhole drilling system of claim 7, further comprising a thermally conductive encapsulant surrounding the magnetic switch, the thermally conductive encapsulant adjoins an outer wall of a drilling fluid channel within the circular cross-section of the downhole drilling system.

9. The downhole drilling system of claim 1, wherein the drill bit is integrated within the bottom-hole assembly.

10. The downhole drilling system of claim 1, wherein the drill bit is one of an electrocrushing drill bit and an electrohydraulic drill bit.

11. The downhole drilling system of claim 1, wherein the secondary coil is electrically coupled with the transformer, and wherein the core is configured to move from a non-saturated state to a saturated state to increase current flow from the secondary coil to the transformer.

12. A method, comprising:

placing a drill bit downhole in a wellbore;

providing electrical power to a pulse-generating circuit coupled to a first electrode and a second electrode of the drill bit;

transforming the electrical power using a transformer of the pulse-generating circuit, wherein the transformer comprises a pulse-generating core, a primary winding electrically coupled with the pulse-generating core and electrically coupled to receive a switch-transformed electrical current and a secondary winding to output a pulse-generating transformed electrical current that is derived from the switch-transformed electrical current flowing in the primary winding;

closing a magnetic switch coupled to the primary winding of the transformer and located downhole within the pulse-generating circuit to charge a capacitor that is electrically coupled between the first electrode and the second electrode, wherein the magnetic switch includes a switch core, a primary coil, and a secondary coil, wherein the primary coil is electromagnetically coupled with a source of the electrical power and a transformer via the primary coil, wherein the primary coil is to receive an input electrical current from the power source, wherein the secondary coil electrically coupled with the switch core, wherein the secondary coil is to output the switch-transformed electrical current to the primary winding of the transformer that is derived from the input electrical current flowing in the primary coil;

forming an electrical arc between the first electrode and the second electrode of the drill bit discharging the capacitor via the electrical arc;

fracturing a rock formation at an end of the wellbore with the electrical arc;

opening the magnetic switch by applying, by a reset-pulse generator, a current to at least one of the secondary coil or the primary coil to move the core from a saturated state to an unsaturated state such that the magnetic switch is returned to being opened in response to the switch core moving to the unsaturated state; and removing fractured rock from the end of the wellbore.

13. The method of claim 12, wherein the current from the reset-pulse generator is a constant current.

14. The method of claim 12, wherein the current from the reset-pulse generator is a pulsed waveform.

15. The method of claim 12 wherein closing the magnetic switch includes:

ramping a voltage to the primary coil to saturate the core.

* * * * *